US010729935B2

(12) United States Patent
DeFalco

(10) Patent No.: US 10,729,935 B2
(45) Date of Patent: Aug. 4, 2020

(54) CERVICAL STRENGTHENING DEVICE

(71) Applicant: Brian A. DeFalco, Waterman, IL (US)

(72) Inventor: Brian A. DeFalco, Waterman, IL (US)

(73) Assignee: Brian A. DeFalco, Waterman, IL (US)

( * ) Notice: Subject to any disclaimer, the term of this patent is extended or adjusted under 35 U.S.C. 154(b) by 111 days.

(21) Appl. No.: 16/010,109

(22) Filed: Jun. 15, 2018

(65) Prior Publication Data

US 2018/0361198 A1 Dec. 20, 2018

Related U.S. Application Data

(60) Provisional application No. 62/521,035, filed on Jun. 16, 2017.

(51) Int. Cl.

| | |
|---|---|
| ***A63B 23/025*** | (2006.01) |
| ***A63B 21/00*** | (2006.01) |
| ***A63B 23/02*** | (2006.01) |
| ***A63B 21/04*** | (2006.01) |
| ***A63B 21/08*** | (2006.01) |
| ***A63B 21/16*** | (2006.01) |
| ***A63B 21/055*** | (2006.01) |

(52) U.S. Cl.

CPC ..... *A63B 23/025* (2013.01); *A63B 21/0442* (2013.01); *A63B 21/0552* (2013.01); *A63B 21/08* (2013.01); *A63B 21/16* (2013.01); *A63B 21/4033* (2015.10); *A63B 21/4039* (2015.10); *A63B 23/0238* (2013.01); *A63B 21/00061* (2013.01); *A63B 21/151* (2013.01); *A63B 2208/0214* (2013.01)

(58) Field of Classification Search

CPC ..... A63B 23/025; A63B 21/4033; A63B 21/0552; A63B 21/16; A63B 21/08; A63B 21/0442; A63B 23/0238; A63B 21/4039; A63B 21/00061; A63B 2208/0214; A63B 21/151

See application file for complete search history.

(56) References Cited

U.S. PATENT DOCUMENTS

| | | | | |
|---|---|---|---|---|
| 1,543,346 A * | 6/1925 | Titus | A63B 23/025 482/10 |
| 2,855,202 A * | 10/1958 | Kinne | A63B 23/025 482/10 |
| 4,222,122 A * | 9/1980 | Toms | A63B 71/10 2/424 |
| 4,645,198 A * | 2/1987 | Levenston | A63B 23/025 482/10 |

(Continued)

*Primary Examiner* — Andrew S Lo

(74) *Attorney, Agent, or Firm* — Miller, Matthias & Hull LLP

(57) ABSTRACT

A cervical spine and muscle strengthening apparatus is provided having a faceplate configured with an opening, a plurality of fastening devices, coupling devices and a resistance source. The plurality of fastening devices may be attached to the faceplate to provide an attachment point at one end of each coupling device. The plurality of coupling devices extends away from the faceplate and attach to the resistance source at the second end of each coupling device. The faceplate may be fabricated from wood, composite, plastic, metal, metal alloy or other suitable material. Additionally, the plurality of fastening devices and coupling devices may be fabricated from metal, metal alloy, composite, plastic, or other such material.

7 Claims, 7 Drawing Sheets

(56) References Cited

U.S. PATENT DOCUMENTS 5,336,138 A * 8/1994 Arjawat ..... A63B 23/025 482/10
5,498,218 A * 3/1996 Proctor ..... A63B 23/025 482/10
5,840,001 A * 11/1998 Schedel ..... A61H 1/0218 482/142
5,928,117 A * 7/1999 Vittone ..... A63B 21/154 473/441
5,984,836 A * 11/1999 Casali ..... A63B 21/0552 482/10
6,000,066 A * 12/1999 Williams ..... A63B 21/065 2/209.13
6,106,437 A * 8/2000 Brooks ..... A63B 23/025 482/10
6,152,857 A * 11/2000 Gonzalez-Leal ..... A63B 21/0552 482/10
6,966,321 B2 * 11/2005 Hess ..... A61F 5/055 128/846
7,390,286 B1 * 6/2008 Edgeton ..... A63B 21/055 482/10
8,876,665 B1 * 11/2014 Isom ..... A63B 23/025 482/10
9,789,350 B1 * 10/2017 Wu ..... A63B 21/065
10,307,636 B1 * 6/2019 Brown ..... A63B 21/4003
D853,574 S * 7/2019 Pribila ..... A63B 21/4003 D24/200
2003/0228955 A1 * 12/2003 Makofsky ..... A63B 21/154 482/10
2004/0058780 A1 * 3/2004 Edgeton ..... A63B 21/055 482/10
2004/0163162 A1 * 8/2004 Benziger ..... A42B 1/08 2/411
2008/0119331 A1 * 5/2008 Zylstra ..... A63B 21/0552 482/10
2009/0318268 A1 * 12/2009 Rosenblum ..... A63B 22/18 482/10
2010/0151995 A1 * 6/2010 Forman ..... A63B 21/00047 482/8
2010/0292051 A1 * 11/2010 Benumof ..... A61H 1/0296 482/10
2011/0136635 A1 * 6/2011 Berc ..... A47C 7/36 482/142
2011/0306470 A1 * 12/2011 Higgins ..... A63B 23/025 482/10
2011/0312476 A1 * 12/2011 Cappellano ..... A63B 23/0216 482/126
2012/0065036 A1 * 3/2012 Abercrombie, Jr. ... A61H 1/008 482/139
2012/0165169 A1 * 6/2012 Gatherer ..... A63B 71/0054 482/139
2013/0053226 A1 * 2/2013 Jiang ..... A63B 21/0414 482/129
2013/0198953 A1 * 8/2013 Long ..... A47G 9/06 5/417
2013/0205480 A1 * 8/2013 Nagely ..... A63B 71/1291 2/425
2014/0018711 A1 * 1/2014 Philipson ..... A61H 1/00 601/38
2014/0051557 A1 * 2/2014 Befeld ..... A63B 21/0552 482/130
2014/0221176 A1 * 8/2014 Zylstra ..... A63B 21/0442 482/124
2014/0296043 A1 * 10/2014 Richardson ..... A63B 21/00043 482/124
2014/0336004 A1 * 11/2014 Gittleson ..... A63B 23/025 482/10
2015/0245940 A1 * 9/2015 Hardcastle ..... A61F 5/055 602/18
2015/0246264 A1 * 9/2015 Lampert ..... A63B 23/035 482/4
2015/0351993 A1 * 12/2015 Murer ..... A63B 23/025 602/36
2016/0236025 A1 * 8/2016 Henan ..... A63B 21/02
2016/0287935 A1 * 10/2016 Sykes ..... A63B 23/025
2017/0128767 A1 * 5/2017 Jolly ..... A63B 21/4043
2017/0203148 A1 * 7/2017 Askins ..... A63B 23/025
2017/0239514 A1 * 8/2017 Hunt ..... A63B 23/025
2018/0126217 A1 * 5/2018 Asanovich ..... A63B 23/025
2018/0353806 A1 * 12/2018 Brask ..... A61G 7/072

* cited by examiner

CERVICAL STRENGTHENING DEVICE

CROSS-REFERENCE TO RELATED APPLICATION

This application claims priority to U.S. Provisional Patent Application No. 62/521,035, filed on Jun. 16, 2017.

FIELD

The present disclosure relates generally to a strengthening device and, more particularly, to an apparatus and method for strengthening the cervical spine and supporting musculature.

BACKGROUND

Mild head and brain injuries such as concussions can be caused by a direct impact to the head as a result of car accidents, bicycle accidents, sports injuries, and other such incidents. Additionally, brain injuries (i.e., concussions) can be caused by a non-contact incident where a rapid acceleration or deceleration jars and/or shakes the brain inside the skull. Regardless of the cause, mild brain injuries and concussions are often associated with a variety of physical, cognitive, and emotional symptoms. Such symptoms can impact a person's ability to perform daily tasks associated with work, school, and other activities, and symptoms may persist for several weeks or more.

The present disclosure is directed to apparatus and methods that may minimize or even prevent certain effects and symptoms, as noted above or otherwise, that result from mild head and brain injuries. However, it should be appreciated that such a benefit is neither a limitation on the scope of the disclosed principles nor of the attached claims, except to the extent expressly noted in the claims. Additionally, the discussion of technology in this Background section is reflective of the inventors' own observations, considerations, and thoughts, and is in no way intended to accurately catalog or comprehensively summarize the art currently in the public domain. As such, the inventors expressly disclaim this section as admitted or assumed prior art. Moreover, any identification or implication above or otherwise herein of a desirable course of action reflects the inventors' own observations and ideas, and should not be assumed to indicate an art-recognized desirability.

SUMMARY

In accordance with one aspect of the present disclosure, a cervical spine and muscle strengthening apparatus is disclosed. The apparatus may include a faceplate having a face hole cut into the faceplate to define a forehead engagement surface above the face hole. Moreover, the apparatus may include a plurality of fastening devices fixedly attached to a front surface of the faceplate. Additionally, a coupling device may be attached to each fastening device of the plurality of fastening devices and the coupling device may be configured to extend away from the front surface of the faceplate. The apparatus may further include a resistance source attached to a second end of the coupling device and an anchor that is fixedly attached to the resistance source. The resistance source may provide a resistance against movement of the faceplate when a force is applied to the faceplate by a user of the cervical spine and muscle strengthening apparatus.

In accordance with another aspect of the present disclosure, a method of using a cervical spine and muscle strengthening apparatus to strengthen a plurality of muscles is disclosed. The method may include attaching a resistance source to an anchor and coupling a faceplate to the resistance source. The method may further include, positioning the face of a user within a face hole formed within the faceplate. Moreover, the method may include engaging a forehead positioning portion of the faceplate with a portion of the user's head. Additionally, the method may include moving the portion of the user's head from an extension position to a flexion position and back to the extension position. Furthermore, the method may include producing a force in response to movement of the portion of the user's head from the extension position to the flexion position, wherein the force opposes the resistance source in order to move the faceplate away from the anchor.

The features, functions, and advantages disclosed herein can be achieved independently in various embodiments or may be combined in yet other embodiments, the details of which may be better appreciated with reference to the following description and drawings.

BRIEF DESCRIPTION OF THE DRAWINGS

While the appended claims set forth the features of the present techniques with particularity, these techniques, together with their objects and advantages, may be best understood from the following detailed description taken in conjunction with the accompanying drawings of which:

It should be understood that the drawings are not necessarily to scale, and that the disclosed embodiments are illustrated diagrammatically, schematically, and in some cases in partial views. In certain instances, details which are not required or helpful for an understanding of the disclosed methods and apparatuses or which render other details difficult to perceive may have been omitted. It should be further understood that the following detailed description is merely exemplary and not intended to be limiting in its application or uses. As such, the present disclosure is for purposes of explanatory convenience only, and it will be appreciated that the disclosure may be implemented in numerous other ways, and within various systems and environments not shown or described herein.

DETAILED DESCRIPTION

In overview, the invention includes, in an embodiment, a faceplate configured with an opening, a plurality of fastening devices, coupling devices and a resistance source. The plurality of fastening devices is attached to the faceplate to provide an attachment point at one end of each coupling device. The plurality of coupling devices extends away from the faceplate and attach to the resistance source at the second end of each coupling device. The faceplate may be fabricated from wood, composite, plastic, metal, metal alloy or other suitable material. Additionally, the plurality of fastening devices and coupling devices may be fabricated from metal, metal alloy, composite, plastic, or other such material.

The opening formed in the faceplate defines a face hole for the user to insert or otherwise engage their head with the invention. The face hole includes foam padding that is glued or otherwise adhered around the edge of the face hole to define an engagement area. The engagement area is configured such that the user's forehead engages the faceplate when the user aligns their head and face within the face hole. The plurality of fastening devices are attached to a surface of the faceplate and one end of a coupling device is fixedly attached to each of the fastening devices. The coupling devices extend away from the faceplate and the opposite end of each coupling device is attached to the resistance source.

The resistance source may be secured to an immobile anchor support such that the resistance source provides the resistance against movement as the user activates the invention.

Figure 1:
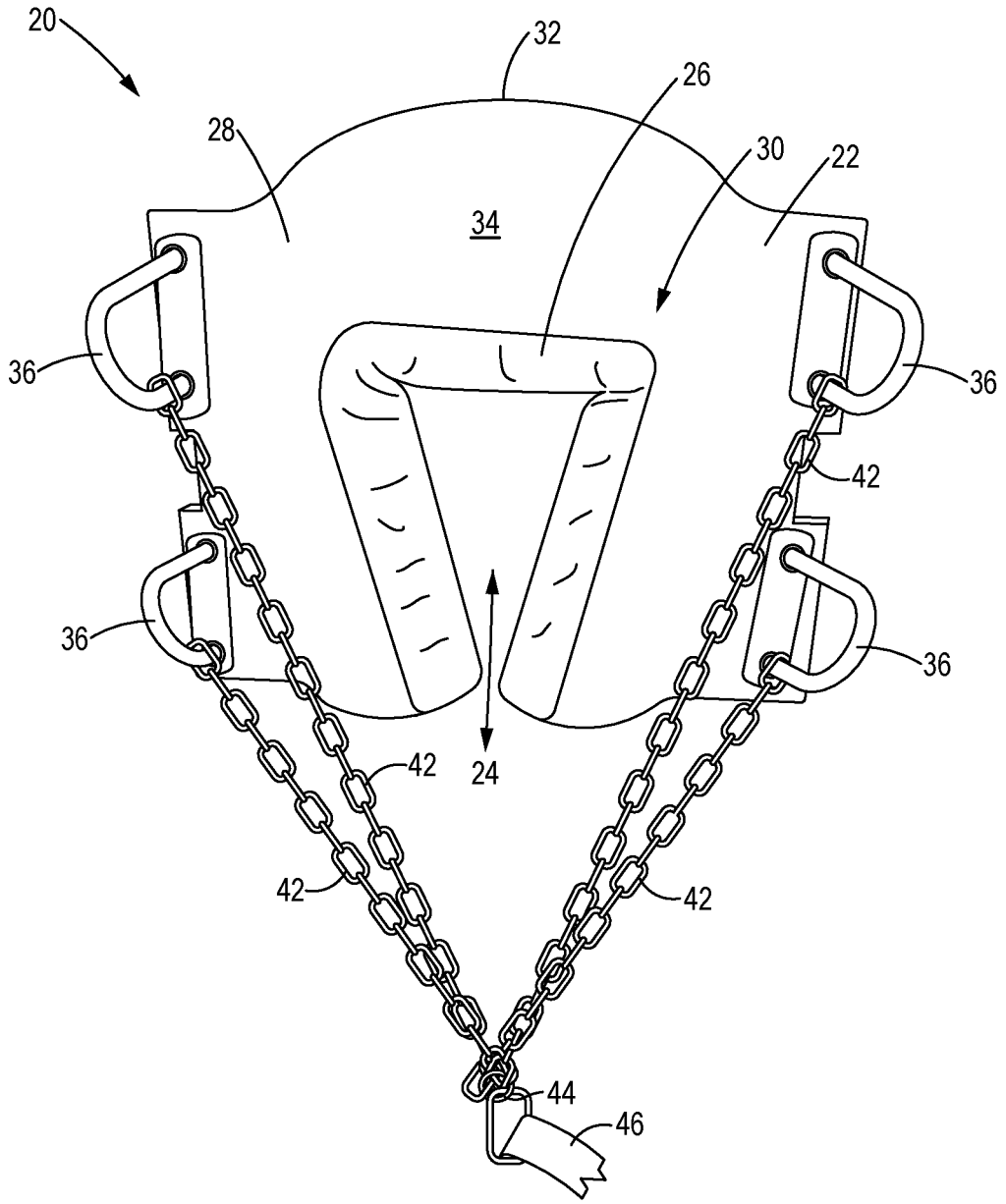
FIG. 1 shows a perspective view of the front side of the apparatus, consistent with an embodiment of the disclosure.

Turning to FIG. 1, a perspective front view of a cervical spine/muscle strengthening apparatus 20 is shown, in accordance with an embodiment of the described principles. In some embodiments, the cervical spine/muscle strengthening apparatus 20 includes a faceplate 22 configured with a face hole 24 cut into the faceplate 22. In one non-limiting example, the face hole 24 is cut to define a u-shaped opening in the faceplate 22; however, other configurations of the face hole 24 are possible. Additionally, the face hole 24 is cut such that the user may position or otherwise align their face within the face hole 24 during use of the cervical spine/muscle strengthening apparatus 20. For example, the face hole 24 may be sized to produce an opening that is 4.5 inches across. Alternatively, the face hole 24 may be made larger and/or smaller to accommodate the size and shape of the head and face of a particular user.

In some embodiments, the face hole 24 is surrounded by a padding 26 (i.e., foam) or other such cushioning. The padding 26 may be formed around the edge of the face hole 24 and secured to the faceplate 22. The padding 26 may provide a comfortable surface for a portion of the user's face when engaged with the faceplate 22 and protect the user from any sharp features formed by the edge of the face hole 24. Additionally, the padding 26 may be used to customize the size and shape of the face hole 24 to ensure a proper fit between the user and the face hole 24. For example, padding 26 with different dimensions (i.e., thinner or thicker) can be used to adjust the fit according to user preference. Furthermore, the padding 26 may fixed to the front surface 28 with a padding fastener 30 such as but not limited to, tape, glue, staples, nails or other such fastening device. Alternatively, the padding 26 may be removably attached to the front surface 28 with padding fasteners 30 such as pins, snaps or other such removable fastening device to accommodate exchanging the padding 26 based on user preference.

The faceplate 22 may be formed from wood, plastic, composite, metal, metal alloy, or other such material. Moreover, the faceplate 22 may be sized to accommodate a wide range of users having different sized heads and faces. In one non-limiting example, the faceplate 22 measures approximately twelve inches across and ten and one half inches high; however other dimensions of the faceplate 22 are possible. Additionally, the faceplate 22 may include at least one arcuate edge 32 that defines a forehead engagement portion 34 along the front surface 28 of the faceplate 22. In some embodiments, the user may position their face and head within the face hole 24 such that the user's forehead engages or directly contacts the forehead engagement portion 34 of the faceplate 22.

Figure 2:
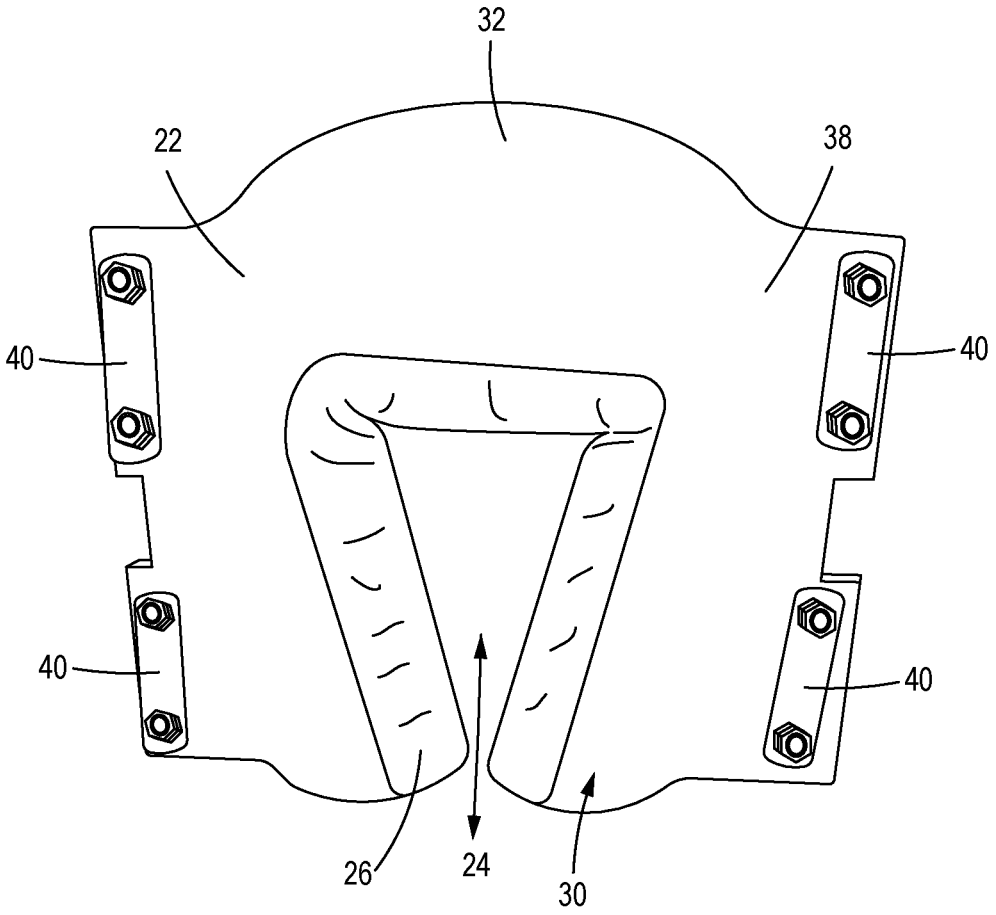
FIG. 2 shows a perspective back side view of the apparatus, consistent with an embodiment of the disclosure.

As further illustrated in FIGS. 1 and 2, the cervical spine/muscle strengthening apparatus 20 includes a plurality of fastening devices 36 such as but not limited to, a U-bolt, square bolt, or other such fastening device. In the illustrated embodiment, there are four fastening devices 36 fixedly attached to the faceplate 22, with one fastening device in positioned in each corner of the faceplate 22. However, an alternative number (i.e., fewer or greater) and positioning of the fastening devices 36 may be used, as desired. Furthermore, each of the fastening devices 36 may be configured to extend through the front surface 28 and secured to the back surface 38 of the faceplate 22 using a nut and plate 40 to securely attach each fastening device 36 to the faceplate 22.

Each fastening device 36 may be attached or otherwise coupled to a first end of a coupling device 42 such as a chain, cable, rope, or other such coupling device 42. Furthermore, each coupling device 42 may be configured to extend away from the front surface 28 of the faceplate 22 such that a second end of each coupling device 42 extends a desired distance away from the front surface 28 of the faceplate 22. In one non-limiting example, the coupling device 42 is configured to extend away up to 12 inches from the front surface 28 of the faceplate 22. However, the coupling device 42 may be configured with other lengths as needed.

Figure 3:
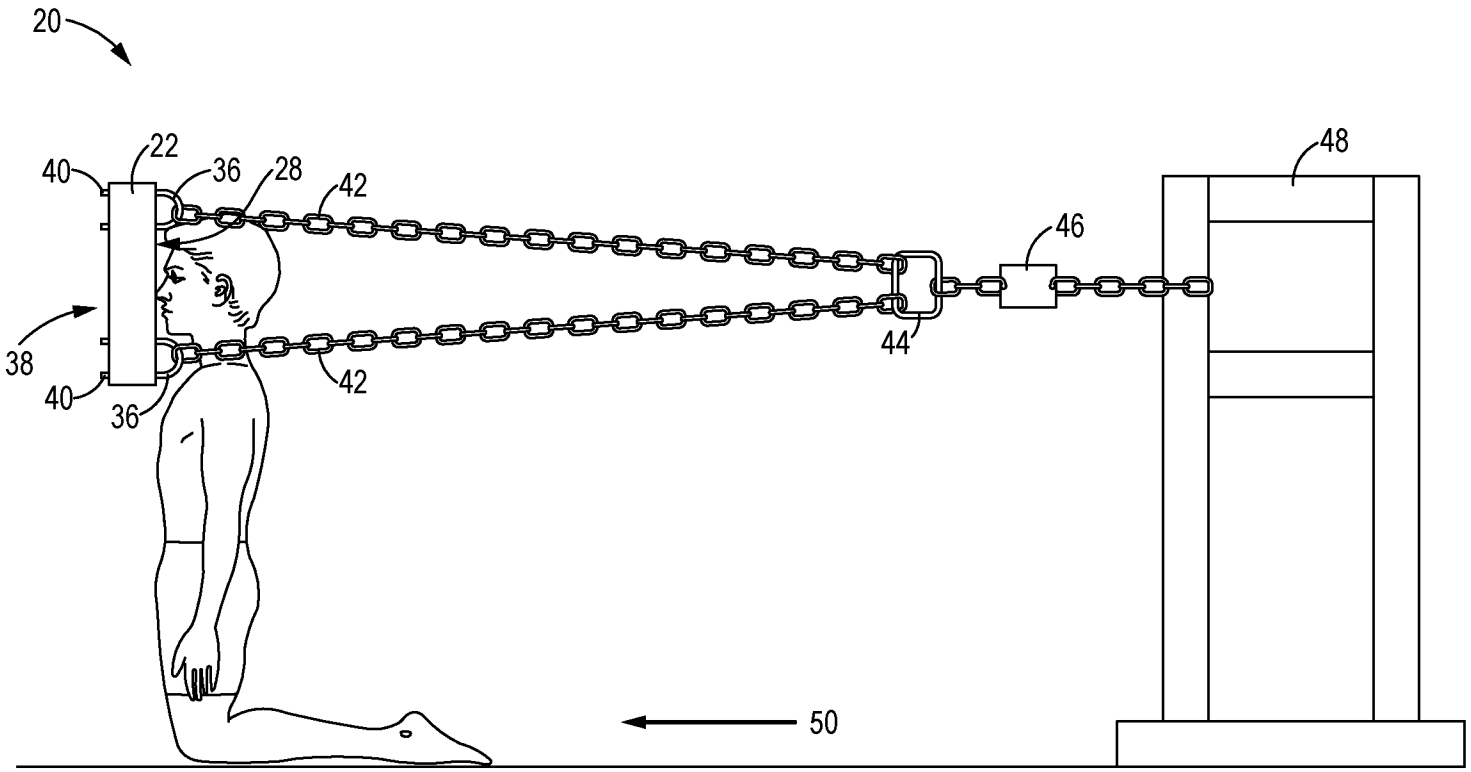
FIG. 3 shows a schematic side view of the apparatus, consistent with an embodiment of the disclosure.

Referring now to FIG. 3, with continued reference to FIGS. 1 and 2, a side view of the cervical spine/muscle strengthening apparatus 20 is illustrated. A user of the cervical spine/muscle strengthening apparatus 20 is shown in a kneeling position and engaging the front surface 28 of the cervical spine/muscle strengthening apparatus 20. However, it will be understood, the user may be in a sitting, standing, or other such position when engaged with and using the cervical spine/muscle strengthening apparatus 20. In some embodiments, the second end of each coupling device 42 connects or otherwise attaches to a D-ring 44 or other such attachment device. Additionally, the D-ring 44 may be attached to a resistance source 46 which is configured to provide a resistive force that opposes moving the faceplate 22 away from the second end of each coupling device 42 and the D-ring 44. In one non-limiting example, the resistance source 46 is a resistance band that is attached to the D-Ring 44 at one end of the resistance band and attached to an anchor 48 (i.e., stationary frame or base) at an opposing end of the resistance band. The resistance source 46 (i.e., resistance band) may be configured with a specified amount of elasticity such that, the user must provide a certain amount of force 50, represented by an arrow illustrated in FIG. 3, on the faceplate 22. The force 50 acts on the faceplate 22 which may result in a pulling or stretching of the resistance source 46 (i.e., resistance band) away from the anchor 48. Furthermore, the resistance source 46 (i.e., resistance band) may be configured to be interchangeable such that a different resistance source 46 (i.e., more elastic, less elastic) can be used to attach the D-ring 44 to the anchor 48 in order to increase or decrease the amount of force 50 needed to pull and or stretch the faceplate 22 away from the resistance source 46 away from the anchor 48.

Alternatively the resistance source 46 may be configured to use a system of weights and pulleys to produce the resistive force that opposes moving the faceplate 22 away from the second end of each coupling device 42 and D-ring 44. Similar to the resistive band described above, the system of weights and pulleys may be attached to the D-ring 44 in order to put a load on the faceplate 22. As a result, the user must provide a certain amount of force 50 in a direction away from the D-ring 44 and resistance source 46. Furthermore, the system of weights and pulleys may be integrated into the anchor 48

Figure 4:
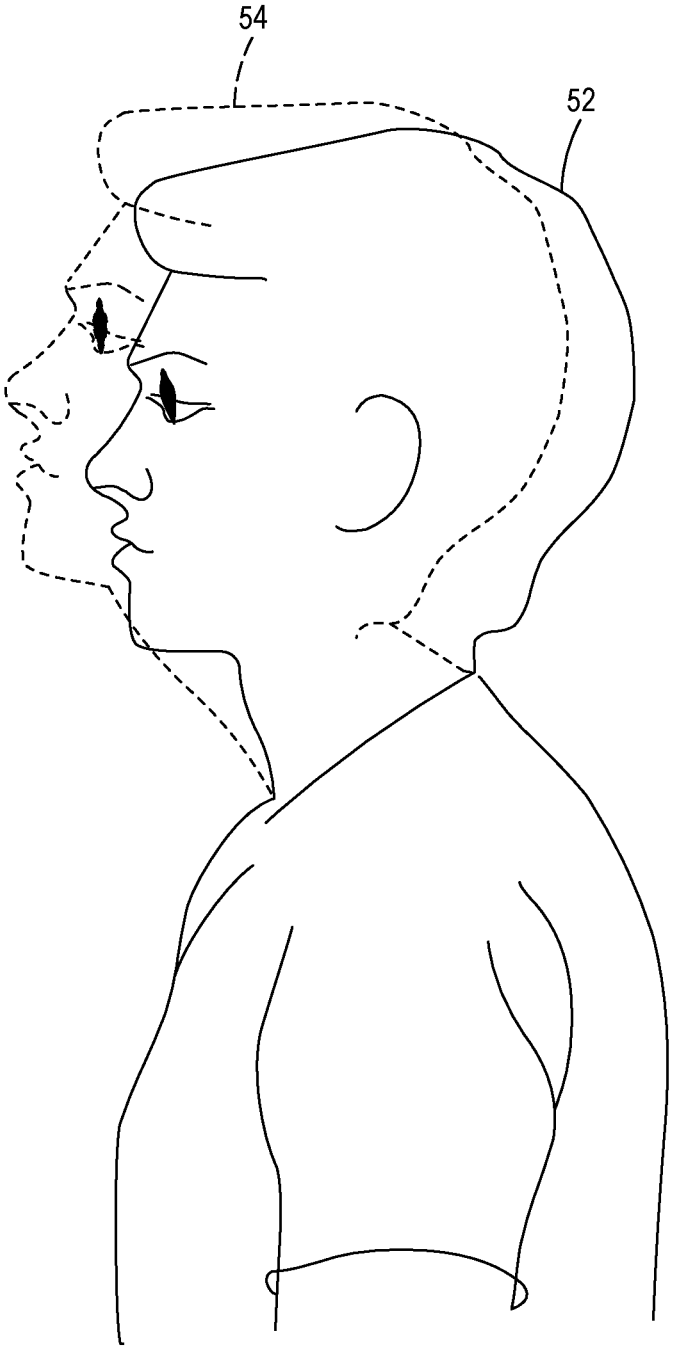
FIG. 4 shows an exemplary movement of a user of the apparatus of FIGS. 1-3, consistent with an embodiment of the disclosure.

Turning to FIG. 4 with continued reference to FIG. 1-3, an exemplary movement or action by the user of the cervical spine/muscle strengthening apparatus 20 is illustrated. In some embodiments, the cervical spine/muscle strengthening apparatus 20 may be used to exercise and strengthen the portions of the cervical spine and muscles that support and stabilize the cranium. As discussed above, the user may align their face and other portion of the head within the face hole 24 and align their forehead to engage with the forehead engagement portion 34 of the faceplate 22. In one non-limiting example, when the user's forehead is placed in direct contact with the forehead engagement portion 34, the user's head may be in a first position 52 where the user's head and neck may be in normal alignment. Put another way, when the user's head is aligned in the first position 52, the user's head and neck may be positioned such that the ear is in radial alignment with the shoulder. Furthermore, when the user is in the first position 52 or starting position, it may be said that the head and neck are positioned with a cervical extension position and an occipital flexion position.

The user may slide or otherwise move the head and neck from the first position 52 to a second position 54. As illustrated in FIG. 4, movement into the second position 54 may include an extension of the neck and rotation of the head such that the user's chin moves upwards and outwards. In some embodiments, when moving from the first position 52 to the second position 54 the head slides into a cervical flexion position and occipital extension position. As a result, movement of the head into the second position 54 may exert force on the cervical spine/muscle strengthening apparatus 20 and pull or stretch the resistance source 46 away from the device anchor 48. Moreover, with the head in the second position 54, the user may slide or otherwise move the head and neck back into the first position 52 Movement of the head back into the first position 52 may reduce the force 50 exerted on the faceplate 22 and the cervical spine/muscle strengthening apparatus 20 will return to the start or rest position. This movement between the first position 52 and second position 54 can be repeated by the user to perform the desired exercise and/or therapy on the cervical spine and supporting musculature. Additionally, in some embodiments, as the user moves the head from the second position 54 back to the first position 52, the head may be pushed or otherwise moved in a rearward direction beyond the first position 52.

Figure 5:
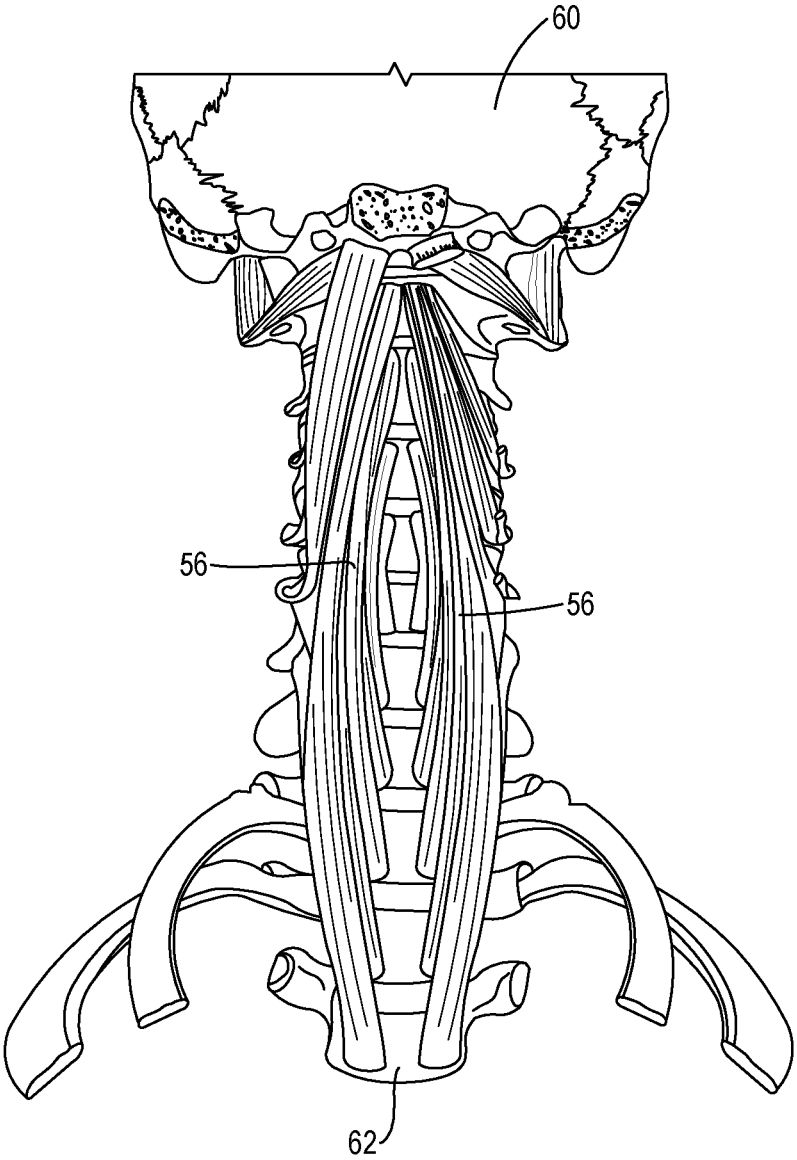
FIG. 5 shows a set of muscles exercised during performance of the movement of FIG. 4, consistent with an embodiment of the disclosure.

Turning to FIG. 5 an exemplary muscle that may be strengthened by using the cervical spine/muscle strengthening apparatus 20 is shown. The longus colli 56 are one set of muscles that may be exercised by engaging the cervical spine/muscle strengthening apparatus 20 and moving or sliding the head between an extension position (i.e., second position 54) and a flexion position (i.e., first position 52). As shown in FIG. 5, the longus colli 56 are a pair of muscles that are anteriorly positioned along a portion of the cervical spine 58 and extend from near the base of the cranium 60 down towards the third thoracic vertebra 62.

Figure 6:
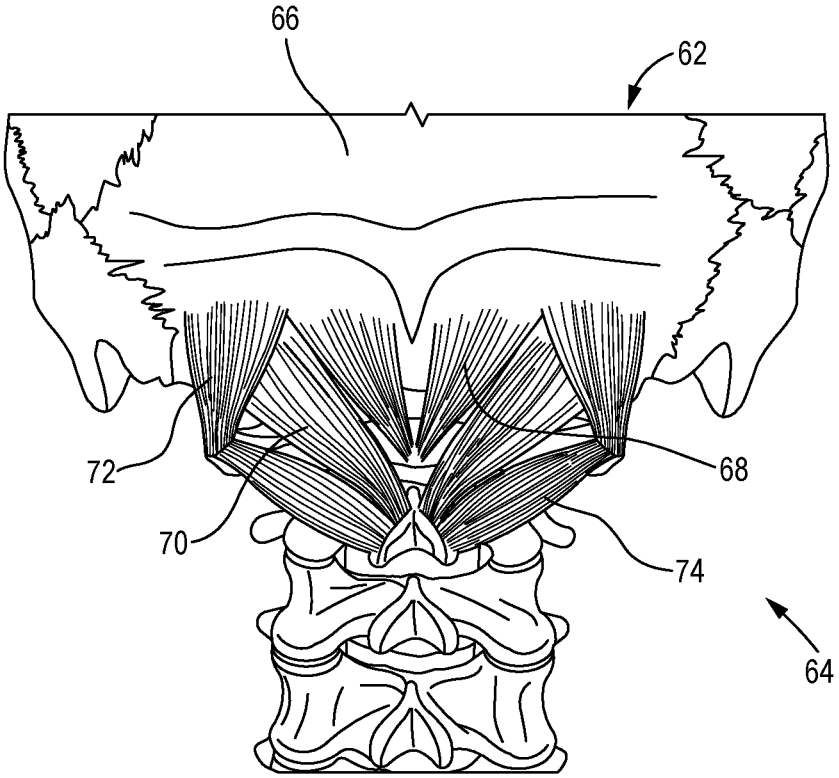
FIG. 6 shows another set of muscles exercised during performance of the movement of FIG. 4.

Turning now to FIG. 6, another set of muscles that may be strengthened using the cervical spine/muscle strengthening apparatus 20 are shown. The suboccipital muscles 64 are another specific group of muscles that may be exercised by engaging the cervical spine/muscle strengthening apparatus 20 and moving or sliding the head between the extension position (i.e., second position 54) and flexion position (i.e., first position 52). As further shown in FIG. 6, the suboccipital muscles 64 are located below the occipital bone 66 of the cranium 60. The suboccipital muscles 64 are composed of four paired muscle groups including the rectus capitis posterior minor 68, the rectus capitis posterior major 70, the obliquus capitis superior 72 and the obliquus capitis inferior 74.

Figure 7:
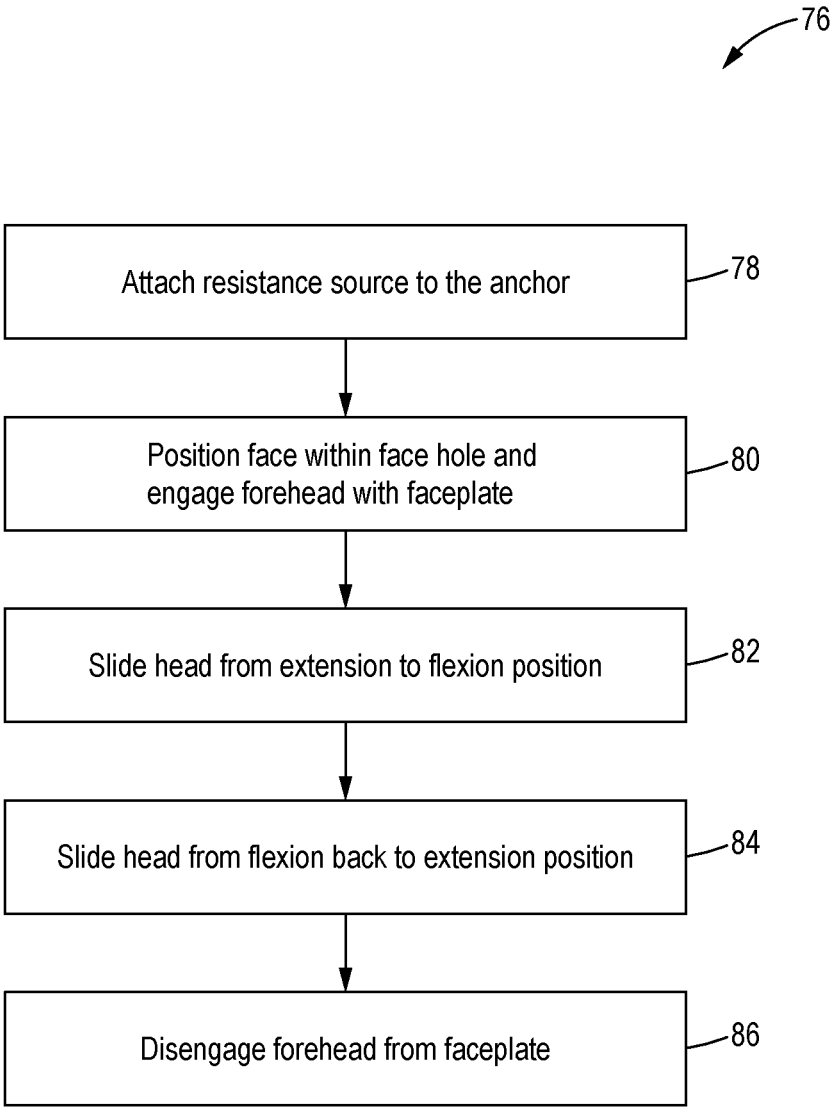
FIG. 7 shows a flowchart of an exemplary method of exercising the muscles of FIGS. 5-6 using the apparatus of FIGS. 1-3, consistent with an embodiment of the disclosure.

Turning to FIG. 7, with continued reference to FIGS. 1-6, an exemplary method 76 to strengthen the cervical spine and muscles is illustrated. In a first block 78 of the method 76, the resistance source 46 is attached to the D-ring 44 and the anchor 48. In some embodiments, the amount of resistance provided by the resistance source 46 may be specifically chosen by the user or other interested personnel in order to customize the amount of exercise and strengthening of the cervical spine and muscles. In some embodiments, the anchor 48 is a rack or other such object that has a sturdy base positioned on the floor. Additionally, the anchor 48 may be selected to have a weight that is several times that of the user to ensure that the anchor 48 does not move during use.

Once the resistance source 46 is properly attached between the faceplate 22 and the anchor 48, then in a next block 80, the user positions their face within the face hole 24 such that the forehead engages with the forehead engagement portion 34 of the faceplate 22. As described above, an embodiment of the cervical spine/muscle strengthening apparatus 20 may be attached to the anchor 48 and positioned such that the user assumes a standing position in order to engage the forehead engagement portion 34 of the faceplate 22. Alternatively, cervical spine/muscle strengthening apparatus 20 may be configured such that the user assumes a sitting position in order to engage the forehead engagement portion of the faceplate 22.

In a next block 82, the user will begin exercising and strengthening the cervical spine 58 and muscles 56, 64 by sliding or moving the head from the extension position (i.e., second position 54) to the flexion position (first position 52). Such movement requires the user's chin to move downward and inward towards the chest. This movement causes an activation of the longus colli muscles 56 that extend along a portion of the cervical spine 58. Furthermore, during a portion of this movement, such as but not limited to the last 20 degrees of movement into the flexion position (i.e., first position 52), the suboccipital muscles 64 are activated.

Once the head is moved into the flexion position (i.e., first position 52), then in a next block 84 the user slides or moves the head from the flexion position (i.e., first position 52) back into the extension position (i.e., second position 54). Such movement requires the user's chin to move upward and outward away from the chest. As a result, the longus colli muscles 56 and suboccipital muscles 64 may be deactivated as the head moves back into the extension position (i.e., second position 54).

In some embodiments of the method 76, the user may repeat blocks 82 and 84 multiple times to strengthen and exercise the cervical spine 58 and muscles 56, 64. When the user is finished with using the cervical spine/muscle strengthening apparatus 20, then in a next block 86 the forehead of the user is disengaged from the forehead engagement portion 34 of the faceplate 22.

Generally, the cervical spine 58, the longus colli muscles 56, and the suboccipital muscles 64 help to support, stabilize, and provide movement of the cranium 60. In certain instances such as but not limited to, a sudden stop and start event and/or direct impact to the head, the cranium and other portions of the head and neck may move in such a manner that results in a concussion or other such brain injury. Repeated use of the cervical spine/muscle strengthening apparatus 20 may help strengthen the longus colli muscles 56 and suboccipital muscles 64 in order to reduce or prevent a concussion injury during certain traumatic head events.

It will be appreciated that example systems and have been disclosed herein. However, in view of the many possible embodiments to which the principles of the present disclosure may be applied, it should be recognized that the embodiments described herein with respect to the drawing figures are meant to be illustrative only and should not be taken as limiting the scope of the claims. Moreover, while some features are described in conjunction with certain specific embodiments, these features are not limited to use with only the embodiment with which they are described, but instead may be used together with or separate from, other features disclosed in conjunction with alternate embodiments.

What is claimed is:

1. A cervical spine and muscle strengthening apparatus, comprising:

a faceplate;

a face hole cut into the faceplate to define a forehead engagement surface above the face hole;

a plurality of fastening devices fixedly attached to a front surface of the faceplate;

a respective coupling device attached to each fastening device of the plurality of fastening devices, wherein each respective coupling device is configured to extend away from the front surface of the faceplate;

a resistance source attached to a second end of each respective coupling device; and an anchor fixedly attached to the resistance source, wherein the resistance source provides an opposing resistance against movement of the faceplate when a force is applied to the faceplate by a user of the cervical spine and muscle strengthening apparatus.

2. The cervical spine and muscle strengthening apparatus in accordance with claim 1, wherein the faceplate includes a padding attached around an edge of the face hole.

3. The cervical spine and muscle strengthening apparatus in accordance with claim 1, wherein the plurality of fastening devices numbers four fastening devices fixedly attached to the faceplate such that one fastening device is positioned in each corner of the faceplate.

4. The cervical spine and muscle strengthening apparatus in accordance with claim 3, wherein each respective coupling device is configured to extend twelve inches away from the front surface of the faceplate.

5. The cervical spine and muscle strengthening apparatus in accordance with claim 4, wherein the second end of each respective coupling device converges and attaches to a D-ring, and wherein the D-ring is further attached to the resistance source.

6. The cervical spine and muscle strengthening apparatus in accordance with claim 1, wherein the resistance source is a resistance band configured to produce the opposing resistance against movement of the faceplate away from the anchor.

7. The cervical spine and muscle strengthening apparatus in accordance with claim 1, wherein the force applied to the faceplate is generated by the user engaging the forehead engagement surface and moving from an extension position to a flexion position.

* * * * *